US007980567B2

(12) United States Patent
Yu et al.

(10) Patent No.: US 7,980,567 B2
(45) Date of Patent: Jul. 19, 2011

(54) SKATE

(75) Inventors: Ting Hung Yu, Guangzhou (CN); Chuan Hung Yu, Guangzhou (CN)

(73) Assignee: Trigold Manufacture Co., Ltd., Nansha District Guangzhou, Guangdong Province (CN)

( * ) Notice: Subject to any disclaimer, the term of this patent is extended or adjusted under 35 U.S.C. 154(b) by 33 days.

(21) Appl. No.: 12/501,377

(22) Filed: Jul. 10, 2009

(65) Prior Publication Data

US 2011/0006511 A1 Jan. 13, 2011

(51) Int. Cl.
*A63C 17/06* (2006.01)

(52) U.S. Cl. ..... 280/11.221; 280/11.231; 280/11.27; 280/11.12; 280/623

(58) Field of Classification Search ..... 280/11.12, 280/11.18, 11.19, 11.221, 11.223, 11.224, 280/11.231, 14.24, 633, 634
See application file for complete search history.

(56) References Cited

U.S. PATENT DOCUMENTS 6,213,479 B1 * 4/2001 Cochimin ..... 280/7.1
7,059,613 B2 * 6/2006 Farrelly et al. ..... 280/11.27
7,766,363 B2 * 8/2010 Farcot et al. ..... 280/618
* cited by examiner

*Primary Examiner* — Jeffrey J Restifo
*Assistant Examiner* — Erez Gurari

(57) ABSTRACT

The present invention provides a kind of skate, including a boot and a skating device connected to the boot, wherein the skating device is arranged along the width direction of the boot. The skate further includes a skating device mount for mounting the skating device to the boot, wherein the skating device can rotate 360 degree under the boot. The transverse skating device under the boot enables the sideward sliding direction, which bring more fun to the skaters. When the skating device is rotated to an angle and locked, the skate can slide inclinedly, which bring more challenges to the skaters. The skating device can rotate 360 degree freely or rotate different angle from two boots under the boot, which can cancel the shift of the knock-knee. The skating device can also be adjusted to be in line on the longitudinal direction as a traditional roller skate or ice skate.

6 Claims, 6 Drawing Sheets

SKATE

BACKGROUND OF THE PRESENT INVENTION

1. Field of Invention

The present invention relates to a kind of skate, and more particularly to a roller skates or ice skates.

2. Description of Related Arts

The general skate is a boot with wheels or blade mounted thereunder, such as roller skates having four wheels equally arranged in two parallel rows for skating on a flat surface and ice skates for skating on the ice. Another kind of the roller skates has four wheels in a row with different heights.

The present roller skate has four wheels in a row arranged in the longitudinal direction along the sole of the boot or four wheels arranged in rectangular shape, or has a blade mounted under the boot for skating on real ice. Theses kinds of skates only can slide forward or backward, but can not slide inclinedly or sidewardly.

SUMMARY OF THE PRESENT INVENTION

An object of the present invention is to provide a skate that can skate inclinedly or sidewardly.

Accordingly, in order to accomplish the above object, the present invention provides a skate comprising a boot and a skating device connected to the boot, wherein the skating device is arranged along the width direction of the boot.

The skate further comprises a skating device mount for mounting the skating device to the boot, wherein the skating device can rotate 360 degree under the boot.

The skate further comprises a round regulating plate detachably mounted to the skating device mount; and the boot has an regulating hole for receiving the regulating plate, wherein the regulating plate has an outer edge and the regulating hole has an inner edge, wherein the outer edge and the inner edge are engaged with each other via teeth provided along the circumferential edges, and a circumferential groove is formed between the outer edge and the skating device mount for engaging the inner edge.

The skating device mount comprises a horizontal plate and a vertical plate form a T-shaped cross section of the skating device mount, wherein the vertical plate has an arch shaped notch at the center edge thereof away from the horizontal plate for receiving a sliding bar when skaters do aggressive skating.

A U-shaped grind is provided in the notch.

The skating device is a set of wheels.

The skating device is a blade.

The boot comprises a front upper and a middle upper whose length is adjustable, and a back upper of fixed length.

The boot comprises a sole, a toe cap that is stretchable along the sole, and a heel that is stretchable along the sole.

The benefit of the present invention is illustrated hereinafter. The skating device is transversely mounted under the boot, so that the skate can slide sidewardly. This kind of skate changes the skating direction of the traditional skate, so as to bring more fun to the skaters and develop new style of skating.

The skating device of the present invention can be rotatable. After the skating device is rotated to a certain angle and then locked, the skater can slide inclinedly, which is challenging. The angles of the skating devices of the left skate and the right skate may be different which brings more challenge for the skaters. The skating device can rotate freely within 360 degree, which enable the compromise of the shift of the knock-knee. The skate of the present invention can also be adjusted to the traditional roller skates or ice skates with a longitudinally arranged wheels or blade.

DETAILED DESCRIPTION OF THE PREFERRED EMBODIMENT

Figure 1:
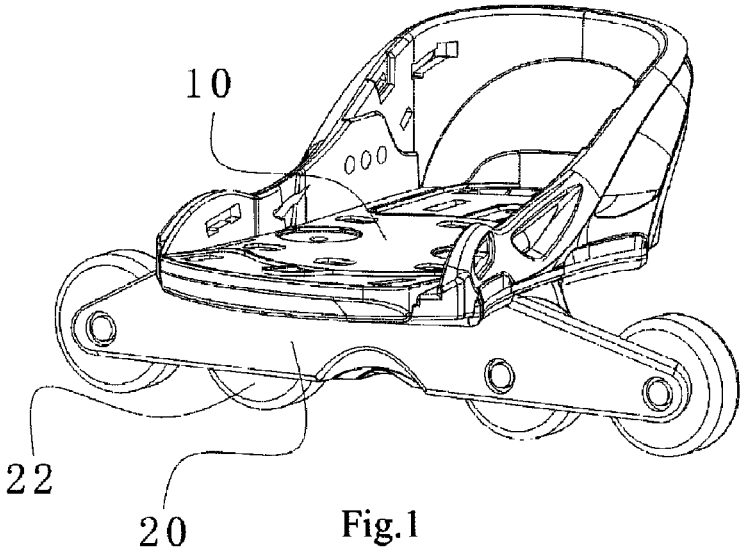
FIG. 1 is a first perspective view of a skate with a transverse skating device according to a preferred embodiment of the present invention.
Figure 2:
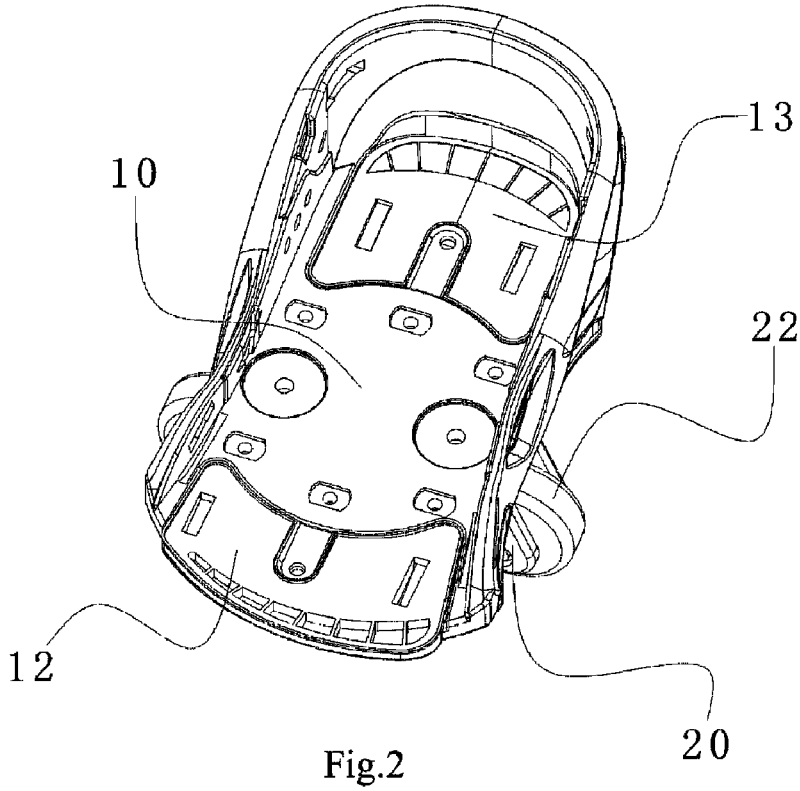
FIG. 2 is a second perspective view of a skate with a transverse skating device according to the preferred embodiment of the present invention.

Referring to FIGS. 1 and 2 of the drawings, one skate according to a preferred embodiment of the present invention is illustrated, in which the skate comprises a boot 10 and a skating device connected to the boot, wherein the skating device is set along the width direction of the boot 10. In other words, the skating direction of the skating device is vertical to the length direction of the boots. The skating device may be wheels 22 for roller skates or blades for ice skates, wherein the wheels and the blades can be detachable and interchangeable, so that one pair of boots can be used in two different occasions. A transverse groove (not shown in Figures) is provided on the bottom of the boot 10 along the width direction of the boot. The skating device (wheels or ice blade) is mounted to the boot 10 via the groove, which means the skating direction of skating device is set along the width direction of the foot in the boot, so that the skate can skate transversely or sidewardly. The direction of the skating device is the lay out direction of the wheels or blade extending. This kind of skate changes the skating direction of the traditional skate, so as to bring more fun to the skaters and develop new style of skating.

Figure 3:
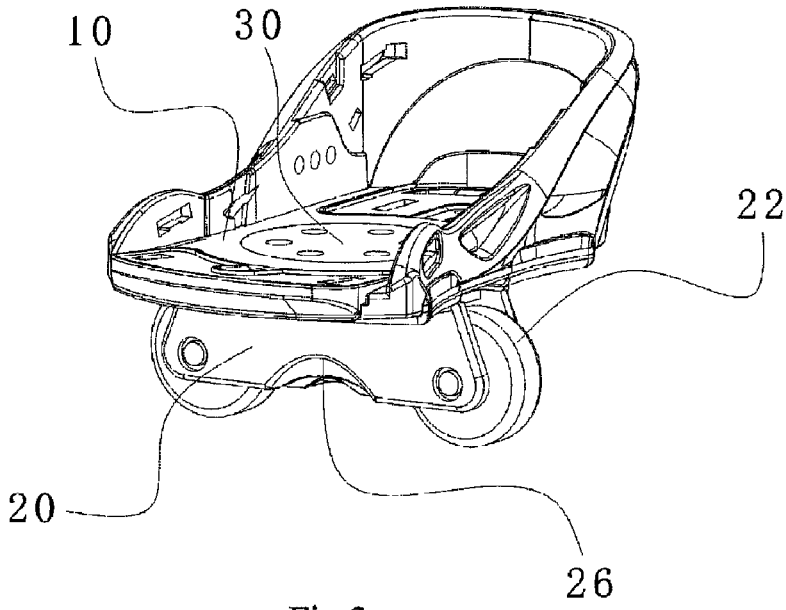
FIG. 3 is a first perspective view of a skate with a rotatable skating device according to the preferred embodiment of the present invention.
Figure 4:
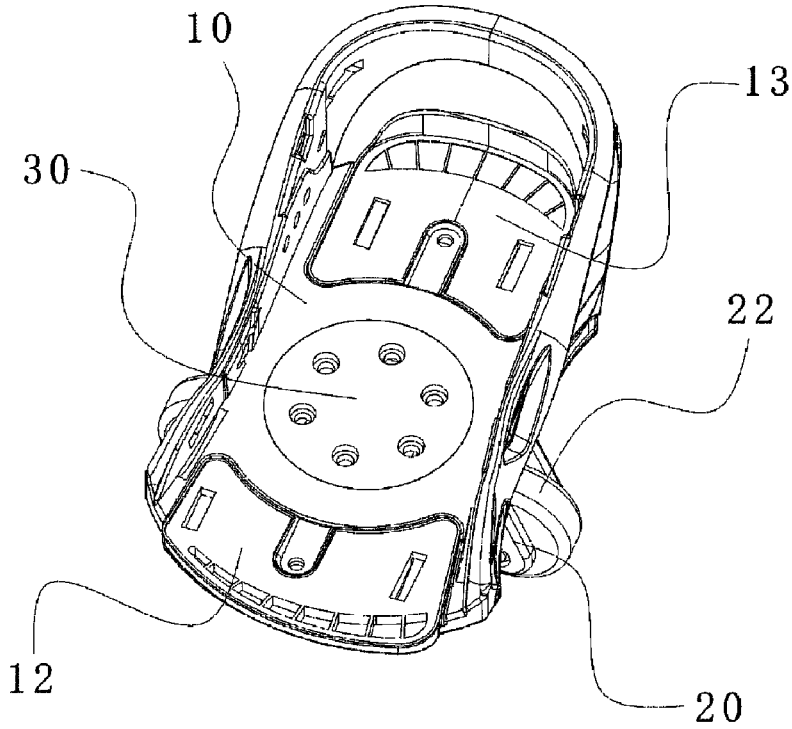
FIG. 4 is a second perspective view of a skate with a rotatable skating device according to the preferred embodiment of the present invention.
Figure 9:
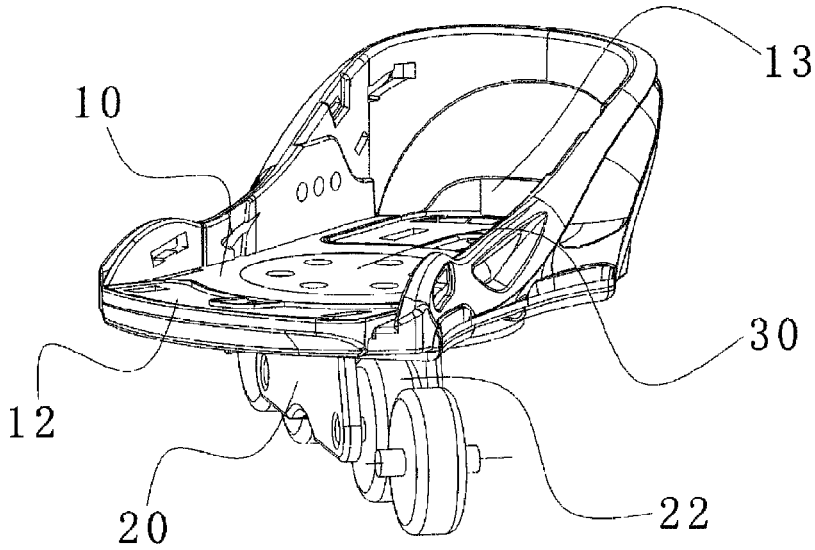
FIG. 9 is a first perspective view of a skate with an inclined skating device according to the preferred embodiment of the present invention.
Figure 10:
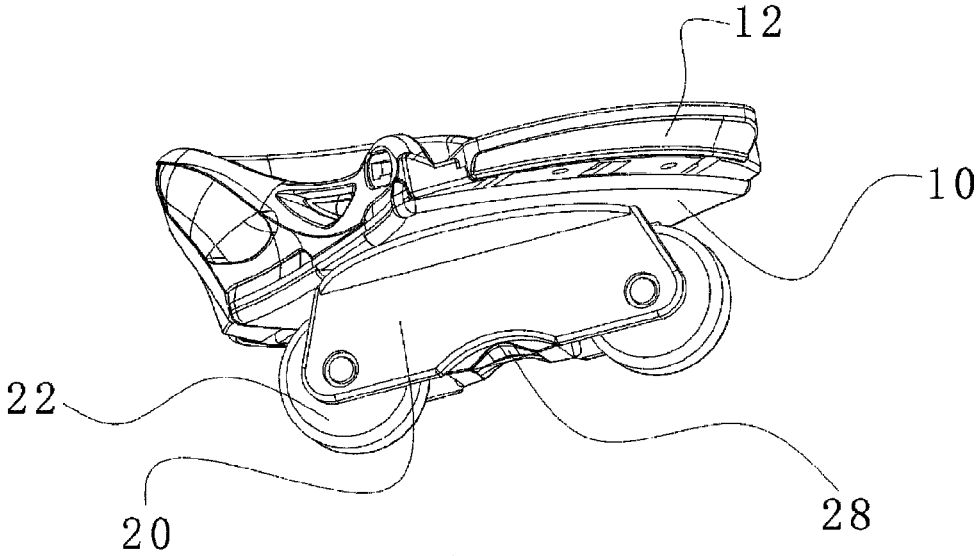
FIG. 10 is a second perspective view of a skate with an inclined skating device according to the preferred embodiment of the present invention.

Preferably, referring to FIG. 3 and FIG. 4 of the drawings, the skate further includes a skating device mount 20 for mounting the skating device to the boot 10, wherein the skating device can rotate 360 degree under the boot. The skating device (including wheels or blade) is fixedly mounted to the skating device mount 20, which is mounted under the bottom of boot 10. When the skating device is regulated to a predetermined direction and then locked to this direction, so that the skating device can rotate freely. In such design, the boot 10 does not have a transverse groove at the bottom thereof. The skate of the present invention comprises a rotatable skating device whose skating angle can be adjusted. The skating device is rotated to a certain angle via the skating device mount 20, and fixedly mounted to the skating device mount 20. When the skating device is rotated to an angle and fixed, the skater can slide obliquely which will be more challenging. As shown in FIG. 9 and FIG. 10 of the drawings, the skating device of the left boot may have different skating angle from the skating device of the right boot, which make the skating more challenging. The skating device can rotate freely within 360 degree. The different angle of the skating devices of the two boots can compromise the shift of the knock-knee. The skate of the present invention can also be adjusted to the traditional roller skates or ice skates with a longitudinally arranged wheels or blade.

Figure 5:
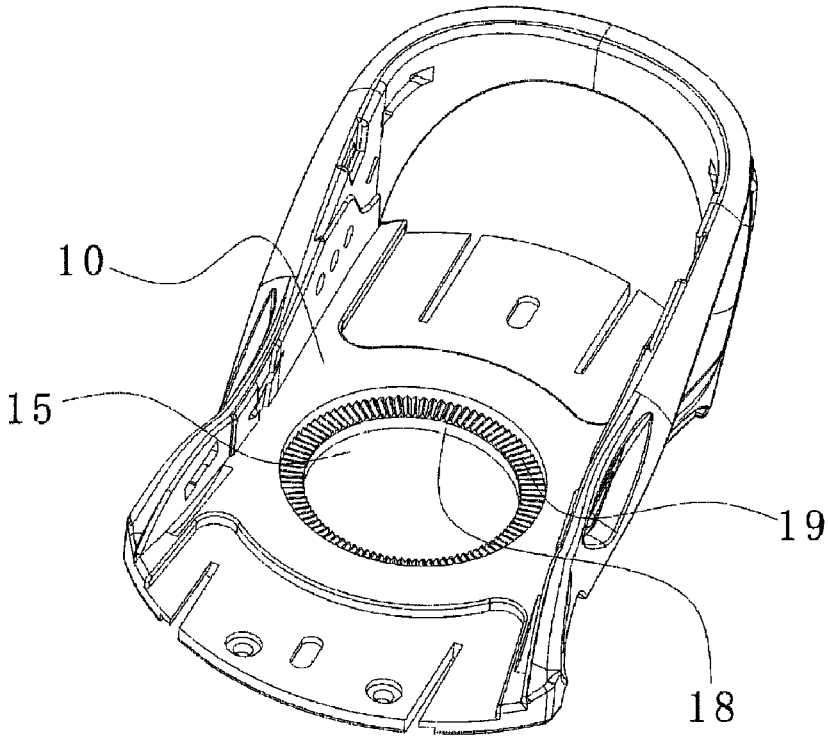
FIG. 5 is a perspective view of a boot of the skate with a rotatable skating device according to the preferred embodiment of the present invention.
Figure 6:
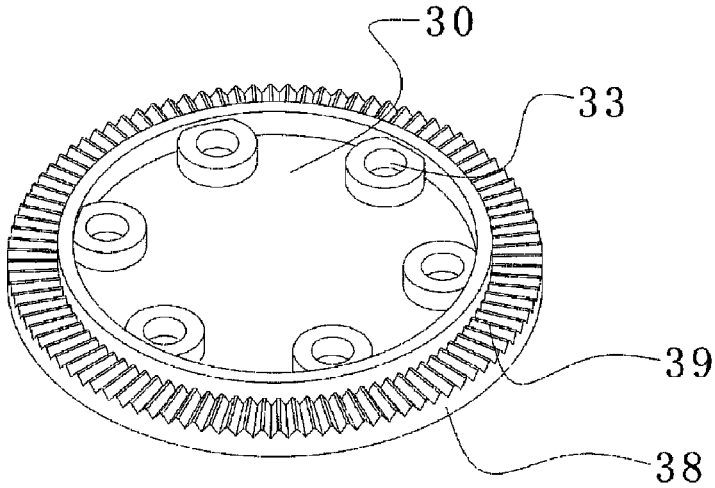
FIG. 6 is a perspective view of a regulating plate of the skate with a rotatable skating device according to the preferred embodiment of the present invention.
Figure 7:
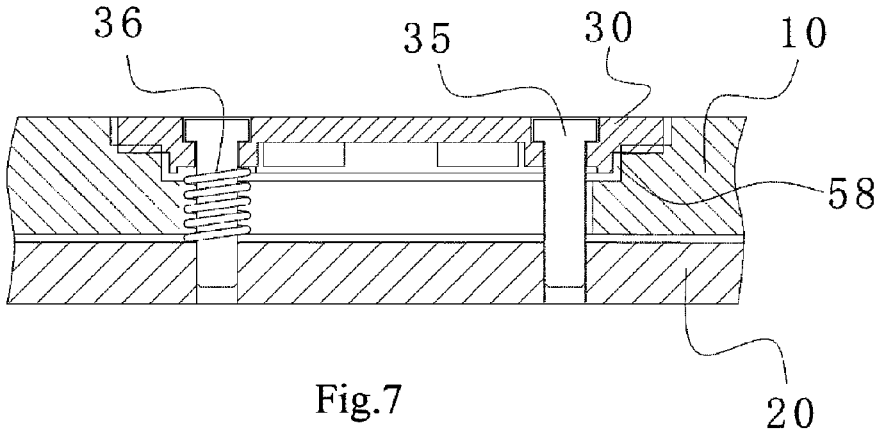
FIG. 7 is a sectional view of a regulating plate of the skate with a rotatable skating device according to the preferred embodiment of the present invention.

Preferably, referring to FIGS. 5, 6 and 7 of the drawings, the skate further comprises a round regulating plate 30 detachably mounted to the skating device mount 20. The boot 10 has a regulating hole 15 for receiving the regulating plate 30. The regulating plate 30 has an outer edge 38 and the adjusting hole 15 has an inner edge 18, wherein the outer edge 38 and the inner edge 18 are engaged with each other via teeth provided along the circumferential edges. A circumferential groove 58 is formed between the outer edge 38 and the skating device mount 20 for engaging the inner edge 18, as shown in FIG. 7. The regulating plate comprises plate teeth 39 along the outer edge 38 thereof, and there is hole teeth 19 along the inner edge 18 of the regulating hole, wherein the hole teeth 19 are engaged with the plate teeth 39. The plate teeth 39 is evenly distributed along the circumferential edge of the regulating plate, and the hole teeth 19 is evenly distributed along the circumferential edge of the regulating hole. The plate teeth 39 and the hole teeth 19 are radially arranged, which is easy to manufacture. The regulating plate 30 is fastened to the skating device mount 20 via bolt 35 or other connecting structures. The inner edge 18 of the regulating hole is engaged into the groove 58 formed between the outer edge 38 and the skating device mount 20. When the plate teeth 39 and the hole teeth 19 are engaged with each other, the regulating plate 30 can not rotate with respect to the boot 10. Unlock the bolt 35 or other connecting structures, the regulating plate 30 and the skating device mount 20 are disconnected, and a gap produced therebetween. The plate teeth 39 and the hole teeth 19 are disconnected and the groove between the outer edge 38 of the regulating plate and the skating device mount 20 is widened, so that the inner edge 18 of the regulating hole of the boot 10 can rotate in the groove so as to adjust the rotate angle.

The regulating arrangement may do not have teeth, but utilizes the friction between the outer edge of the regulating plate and the inner edge of the regulating hole to lock the inner edge so as to lock the boot 10 and the skating device mount 20.

The regulating plate 30 can unrotatably connect to the skating device mount 20 via a straight pole such as a bolt 35, and can connect directly to the skating device mount 20 in a thread manner on the condition without plate teeth and hole teeth.

Preferably, in order to ensure the rotation of the inner edge 18 of the regulating hole after the regulating plate 30 and the skating device mount 20 are disconnected, an elastic element is provided between the regulating plate 30 and the skating device mount 20 to keep the disconnection between the regulating plate 30 and the skating device mount 20. The elastic element is a spring 36. At least there springs are evenly distributed between the regulating plate 30 and the skating device mount 20.

Figure 8:
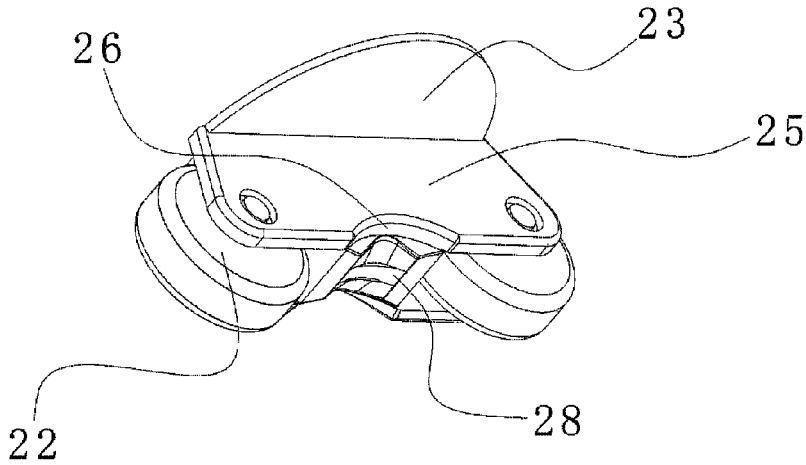
FIG. 8 is a perspective view of a skating device mount and wheels according to the preferred embodiment of the present invention.

Preferably, referring to FIG. 8 of the drawings, the skating device mount 20 comprises a horizontal plate 23 and a vertical plate 25 form a T-shaped cross section of the skating device mount 20. The vertical plate 25 has an arch shaped notch 26 at the center edge thereof away from the horizontal plate 23 for receiving a sliding bar, so that the skate can slide on a sliding bar. Two sides of the T-shaped skating device mount 20 are approximately right-angled, which can also be used to slide on a sliding bar. When the skating device is a blade, only inner right-angled side can be used to slide.

Preferably, in order to prolong the life span of the skates and sliding components, a U-shaped grind 28 is provided in the notch.

Preferably, the skating device is a set of wheels 22, comprising four wheels equally arranged in two parallel rows or two, three, four or even more wheels in one row. The number of the wheels is depending on the size of the wheel. The roller skate of two wheels has more satiability and good balance. The roller skate of three or more wheels has more security. Of course, in order to increase the difficulty of the skate, and to bring more challenge and fun, the roller skate may have only one wheel.

Figure 11:
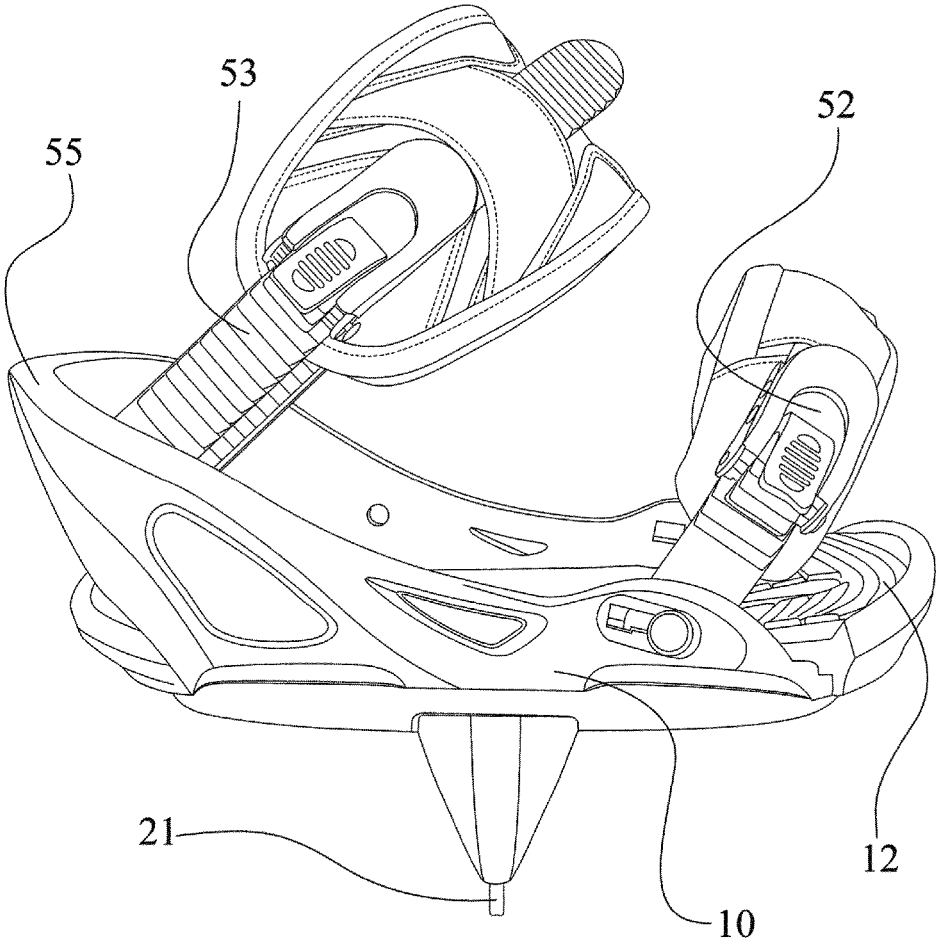
FIG. 11 is a structural representation of a skate with an upper according to the preferred embodiment of the present invention.

Preferably, the skating device is a blade 21, as shown in FIG. 11.

Preferably, referring to FIG. 11 of the drawings, the length of the front upper 52 of the boot and the middle upper 53 of the boot can be adjusted, and he length of the back upper 55 of the boot is fixed. The boot 10 may be design to a normal boot or a boot frame for receiving a shoe therein, so that the wearer can put his own shoe in the boot frame. Via adjusting the length of the front upper and middle upper, the skate can suitable for skaters with different sizes of the foot or shoe.

Preferably, the boot 10 comprises a sole, a toe cap 12 that is stretchable along the sole, so as to be suitable for the skaters with different sizes of the foot. In order to increase the stretching range of the boot maximally, the boot further comprises a heel that is stretchable along the sole.

One skilled in the art will understand that the embodiment of the present invention as shown in the drawings and described above is exemplary only and not intended to be limiting. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A skate, comprising:

a boot;

a skating device connected to the boot and capable of being arranged along the width direction of the boot;

a skating device mount for mounting the skating device to the boot and capable of rotating 360 degree under the boot; and a round regulating plate detachably mounted to the skating device mount, wherein the boot has an regulating hole for receiving the regulating plate, the regulating plate has an outer edge and the regulating hole has an inner edge, the outer edge and the inner edge are engaged with each other via teeth provided along circumferential edges, a circumferential groove is formed between the outer edge and the skating device mount for engaging the inner edge;

wherein the skating device mount comprises a horizontal plate and a vertical plate form a T-shaped cross section of the skating device mount, wherein the vertical plate has an arch shaped notch at the center edge thereof away from the horizontal plate for receiving a sliding bar during the aggressive skating.

2. The skate, as recited in claim 1, wherein a U-shaped grind is provided in the notch.

3. The skate, as recited in claim 1, wherein the skating device is a set of wheels.

4. The skate, as recited in claim 1, wherein the skating device is a blade.

5. The skate, as recited in claim 1, wherein the boot comprises a front upper and a middle upper whose length is adjustable, and a back upper of fixed length.

6. The skate, as recited in claim 1, wherein the boot comprises a sole, a toe cap that is stretchable along the sole, and a heel that is stretchable along the sole.

* * * * *